United States Patent [19]

Parham

[11] Patent Number: 4,509,588

[45] Date of Patent: Apr. 9, 1985

[54] HEAT RECLAIMER

[75] Inventor: Fred Parham, Corydon, Iowa

[73] Assignee: Deflecta-Shield Corporation, Corydon, Iowa

[21] Appl. No.: 380,093

[22] Filed: May 20, 1982

[51] Int. Cl.[3] ..... F24B 7/02

[52] U.S. Cl. ..... 165/80 R; 165/122; 165/139; 165/154; 165/169; 165/DIG. 2; 237/55

[58] Field of Search ..... 165/47, DIG. 2, 180, 165/122, 169, 185, 80 R, 80 D, 80 E, 76, 139, 154, 138; 237/55

[56] References Cited

U.S. PATENT DOCUMENTS

| | | | |
|---|---|---|---|
| 340,468 | 4/1886 | Walton | 165/80 E |
| 607,033 | 7/1898 | Gresty | 165/180 |
| 1,631,721 | 6/1927 | De Boischevalier | 165/DIG. 2 |
| 2,693,941 | 11/1954 | Bystrom | 165/122 |
| 3,410,544 | 11/1968 | Beck | 165/169 |
| 4,103,192 | 7/1978 | Wendt et al. | 165/185 X |
| 4,276,926 | 7/1981 | Euangelow | 165/47 X |
| 4,309,875 | 1/1982 | Radichio | 165/154 X |
| 4,313,562 | 2/1982 | White | 165/DIG. 2 |
| 4,381,819 | 5/1983 | Paolino | 165/47 X |
| 4,390,060 | 6/1983 | Reinke et al. | 165/DIG. 2 |

*Primary Examiner*—Sheldon J. Richter

*Attorney, Agent, or Firm*—Zarley, McKee, Thomte, Voorhees & Sease

[57] ABSTRACT

A device for reclaiming heat from stove pipes and the like. A semi-circular shaped hollow enclosed housing with a highly thermal-conductive concave surface is mounted contactingly to surround approximately one-half of the circumference of the stove pipe. The concave surface is formed to contact the pipe at a maximum number of points along that surface. The hollow interior of the housing contains thin multi-surfaced projections which are integral with the concave surface and conductively transfer heat from the stove pipe and concave surface to heat the air in the housing. A fan blower is attached via an air conduit to an entrance opening in the housing. When turned on, the blower pushes the heated interior air out a plurality of air exit openings in the ends of the housing and brings in lower temperature outside air for heating.

10 Claims, 4 Drawing Figures

HEAT RECLAIMER

BACKGROUND OF THE INVENTION

1. Field of Invention.

This invention relates to devices for reclaiming heat, more particularly to devices for reclaiming heat from stove pipes, furnace flues, and the like.

2. Description of the Prior Art.

All devices which generate heat lose a proportion of that heat during generation and any subsequent transportation of that heat. A primary example exists with respect to a wood burning stove. The combustion of the fuel serves to create by-products of heat. Some of this heat is dissipated in the body of the stove itself, some is dissipated in heating the air inside and surrounding the stove, and other heat is dissipated through the exhaust by-products of combustion and into the exhaust pipe or stove pipe which carries these exhaust by-products. Therefore, the heat contained in the exhaust stage presents an attractive source for heat reclamation, as it would more or less be wasted by exhausting it.

Various attempts to reclaim this heat have been made in the past, employing various designs.

A majority of the prior heat reclaimers utilize designs which completely surround a stove pipe or furnace flue. An air chamber is then primarily heated by the radiant heat of the stove pipe and then exited for use by a blower or fan. This type of design does avoid using or processing the exhaust by-products, which would make the device much more complicated and potentially unsafe because of harmful exhaust fumes, but it relies solely on the radiant heating of the air in its chamber for heat reclamation.

Improvements upon this design worked to modify the stove pipe itself to present a larger stove pipe area to the air chamber to allow more heat to be transferred to the air. Typical of this design is the Feldman U.S. Pat. No. 4,117,883, which utilized a plurality of pipes connected in parallel with the stove pipe and which in turn were surrounded by the air chamber. Again, the heat transfer occurs solely on the basis of conduction of the pipes to the air. Though efficiency may be increased by presenting a larger surface area of stove pipe to the air, the increased size of the air chamber decreases the efficiency by which the air may be heated.

Alternatively, devices were designed to be inserted between sections of a stove pipe or the like. This required greater complexity and flexibility in design, though the principles remain basically the same. Generally, these designs attempt to extract heat from the exhaust of a heat source, by having the exhaust directly contact the device and then conducting the extracted heat to an air chamber. Some designs also use conduction from the pipe through solid material to transport the heat to the air chamber more efficiently. However, all these types of prior devices completely surround the exhaust channel thereby contributing to the problem of creosote build-up on the inside of the exhaust channel. Additionally, the air chambers of these devices are usually large in volume, thereby reducing the potential efficiency of the heat reclaimers.

Creosote build-up is a significant problem in that its build-up on the inside of a stove pipe, furnace flue or exhaust channel not only reduces the efficiency of the heat source, whether a stove, furnace, or the like, but greatly increases the danger of "chimney fire" or back up of noxious or toxic fumes. Some heat reclaimers have attempted to solve this problem by relying on metal-to-metal heat conduction in order to heat the air chamber and then subsequently exhaust the heated air by a fan or blower. Was, U.S. Pat. No. 4,103,826 is an example of such a device. However, it is inefficient because the contact area between the stove pipe and the device is very small; a tubular surface against a tubular surface. Also, the large air chamber of Was causes any conducted heat to dissipate quickly, thereby further rendering the device rather inefficient.

It is therefore an object of this invention to provide a heat reclaimer which is thermo-dynamically efficient.

Another object of this invention is to provide a heat reclaimer which provides a large conductive contact surface with the heat source, but does not unduly enhance the potential for creosote build-up.

Another object of this invention is to provide a heat reclaimer which presents a large heat dispersing area to the air chamber for efficient reclamation of heat.

A further object of this invention is to provide a heat reclaimer which has a high ratio of heat dispersing area to air chamber volume, so that heat is not quickly dispersed within the air chamber before it can be exhausted for use.

Another object of this invention is to provide a heat reclaimer which may be easily installed in existing facilities and which requires no modification to the existing structures.

Another object of this invention is to provide a heat reclaimer which has a highly thermal conductive contacting surface with the heat source.

A further object of this invention is to provide a heat reclaimer which may be thermostatically controlled in its operation.

Additional objects, features and advantages of the invention will become apparent with reference to the accompanying specification and drawings.

SUMMARY OF THE INVENTION

This invention utilizes a highly thermal conductive interfacing surface which is conformed to fit contactingly around half the circumference of a stove pipe or the like. This surface forms one side of a housing which defines an air chamber. An opposite concentric wall forms the other major side of the housing and is spaced so that the air chamber is a narrow semi-circular volume. The invention is attached to the stove pipe by semi-circular mounting brackets which extend from both ends of the housing around the other half of the circumference of the stove pipe. A plurality of thin projections extend inside the air chamber from the interface surface towards the concentric outer wall throughout the air chamber, presenting a high ratio of heat dispersion area to air volume. A blower which is thermostatically controlled with respect to the temperature of the air chamber is communicated with the air chamber and when operated, forces air out of the air outlet openings in the housing.

The housing presents essentially an enclosed air chamber with the projections extending substantially from the interface surface to the outer wall throughout the chamber. The projections are constructed either of narrow triangular pieces with the base of the triangle attached to the interface surface, or the projections may be constructed in a hollow cone-like configuration. The thin edges of the projections are more conducive to the conductive transfer of heat from the interface surface than other configurations. Therefore, a more efficient transfer from the heat source is effected.

The narrow width of the air chamber provides for more efficient heating of the air which will subsequently be moved out of the air outlets to be used for heating purposes.

Copper is used for the entire contact surface of the interface surface. While being more expensive than many other materials, it provides one of the most efficient mediums for conductive transfers of heat from the heat source with the possible exception of silver, the use of which is not commercially feasible.

DETAILED DESCRIPTION OF THE PREFERRED EMBODIMENT

Figure 1:
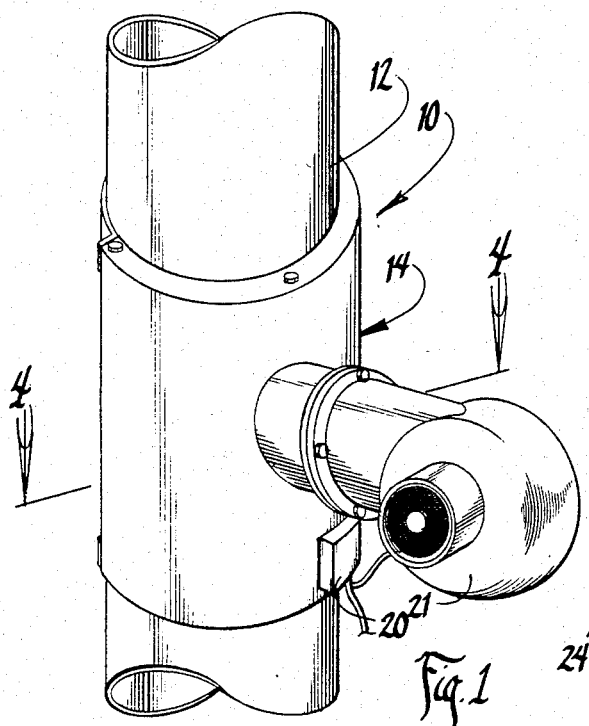
FIG. 1 is a perspective view of the invention showing it attached to a stove pipe.

In reference to the drawings, and particularly FIG. 1, there is shown a heat reclaimer 10, in accordance with the invention, mounted upon a tubular pipe 12 emanating from a heat source, such as a stove or furnace. Pipe 12 carries hot exhaust by-products of the heat source and gains heat by conduction from the exhaust.

A housing 14 defining an air chamber 16 (shown in FIGS. 2 and 4), contacts pipe 12 in a manner to, in turn, efficiently conduct heat from pipe 12. A blower 21 and thermostat 20 are operatively attached to the housing.

Figure 2:
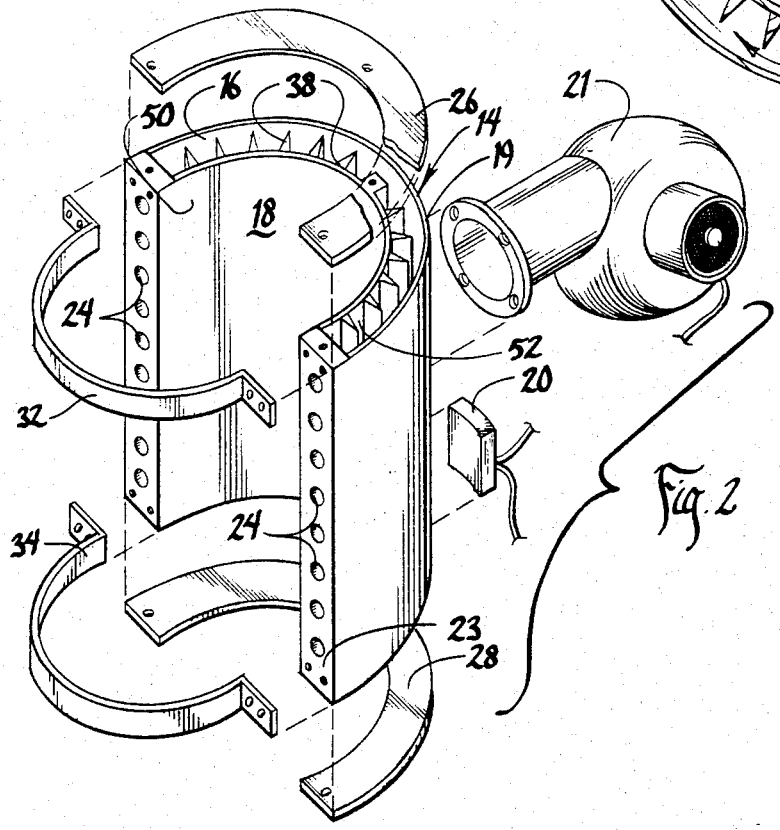
FIG. 2 is an exploded perspective view of the invention in its unattached state.

The structure of heat reclaimer 10 is more specifically set forth in FIG. 2. Housing 14 is comprised of a concave interface surface 18 made of a highly thermal conductive material. Interface surface 18 has an exterior side 50 adjacent pipe 12, and an interior side 52 adjacent air chamber 16. A concentric outer wall 19 combines with interface surface 18 to define the width of air chamber 16. Two end pieces 22 and 23 contain outlet openings 24 which are in fluid communication with chamber 16. Top piece 26 and bottom piece 28 complete the housing rendering the air chamber 16 enclosed, except for openings 24 and an inlet opening 30 for fluid communication of blower 21.

Semi-circular brackets 32 and 34 removably attach to end pieces 22 and 23 and serve to hold housing 14 in thermal conductive contact with pipe 12. Projections 38 are attached along the interior side 52 of interface surface 18 and extend throughout air chamber 16.

Figure 3:
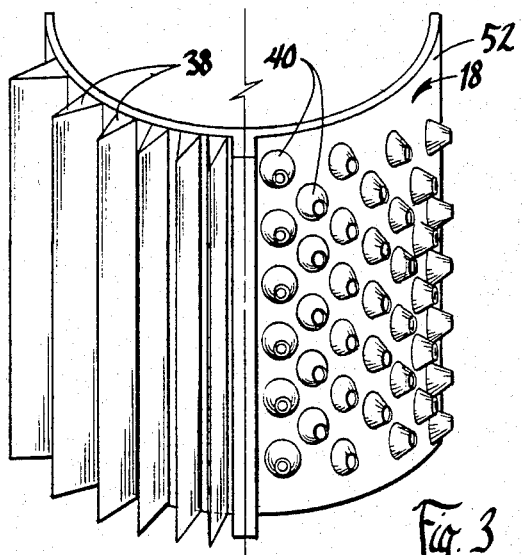
FIG. 3 is a rear perspective view of the heat interface surface showing two embodiments of the heat dispersion projections.

Projections 38 serve to conduct the heat derived by interface surface 18 from pipe 12 to the air of chamber 16. Since heat in solids is most efficiently conducted via thin materials with thin edges, projections 38 can be made in a number of configurations and retain needed efficiency. With reference to FIG. 3, two embodiments of projections 38 are shown. Triangular projections 38 have their bases attached to interface surface 18 and extend their points through air chamber 16 towards outer wall 19. Triangular projections 38 are closely spaced together and extend longitudinally down the entire axial length of the interior side 52 of interface surface 18. Alternatively, cone-shaped projections 40 are pushed out of the interface surface 18 and therefore present a plurality of hollow cone-shaped extrusions. Both designs serve to provide a maximum heat dispersion area of a thin thermal conductive material, which serves to efficiently conduct heat into the air of chamber 16.

Figure 4:
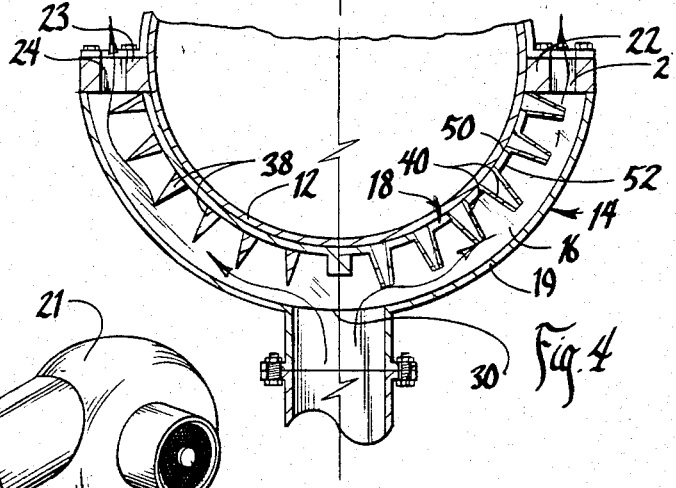
FIG. 4 is a top sectional view taken along lines 4—4 of FIG. 1.

In operation, heat reclaimer 10 is mounted upon a heated surface 12 so that interface surface 18 is held in thermal conductive contact with heated surface 12. When the temperature of the air in air chamber 16 reaches a temperature of 140° F., thermostat 20 turns on blower 21 so that heated air in chamber 16 is forced out of exit openings 24, where it then heats the surrounding air or can be used in other ways. FIG. 4 shows this operation.

The air of air chamber 16 becomes heated because interface surface 18 is made of a highly thermal conductive material, usually copper, which efficiently conducts heat from the heated surface 12. Projections 38 in turn conduct the heat from interface surface 18 into air chamber 16. The high ratio of the heat dispersion area of the projections 38 to the volume of air in air chamber 16 increases heating efficiency by not allowing the conducted heat to be dispersed throughout a large air volume. Heat, and any exchange process on a continuous metal surface, tends to migrate to the edges of that surface. Projections 38 having a greater number of edges and each being thinner than other materials used in other heat exchangers, allows the heat exchange process to effectively and efficiently draw heat from the heat source wall 12 to the metal of the interface surface 18 and transfer it to the tips and edges of projections 38.

Blower 21 thus continues operation, bringing in cooler outside air until the temperature of the air in chamber 16 decreases to approximately 110° F., or below, wherein thermostat 20 shuts off blower 21, allowing the interior air to heat up again, to a point where thermostat 20 will again cause blower 21 to operate.

The description above is the preferred embodiment of the invention; however, it is to be understood that changes can be made in the preferred embodiment herein.

What is claimed is:

1. A device for reclaiming heat from a stove or furnace flue or the like which can be retrofitted without any modification to the flue comprising:

a concavely shaped housing defining an enclosed air chamber having a concave interior wall made of highly thermal conductive material, a concentric outer wall spaced apart from the inner wall, top and bottom end walls, and edge walls, said interior and outer walls extending approximately halfway circumferentially around said flue;

heat transfer members projecting from the inward facing surface of said interior wall of said housing being integrally formed with said interior wall and extending throughout said air chamber so as to substantially fill up the space between said interior and said outer wall, said heat transfer members being thinnest at their very outwardmost edges;

an air inlet means in said outer concentric wall of said housing for inlet of pressurized unheated air from a pressurized air source;

an air outlet means positioned along each said edge wall for the outlet of heated air from said air chamber; and attachment means for movably attaching said housing to said flue in such a manner that said interior surface is in conforming thermal conductive contact at a maximum number of points approximately halfway circumferentially around said flue.

2. The device of claim 1 wherein said heat transfer members comprise a plurality of spaced apart thin, elongated projections made of thermal conductive material attached throughout said interior wall of said housing and extending into and across said air chamber, so that heat derived from said stove or furnace flue or the like by said interior wall is in turn conductively transferred to the thin edges of said transfer members, which present a large heat disbursing area, for subsequent transfer to the air in said air chamber.

3. The device of claim 2 wherein said transfer members comprise narrow, triangular-in-cross-section shaped projections.

4. The device of claim 3 wherein said triangular projections are attached to said inward facing surface of said interior wall at spaced apart positions and run perpendicularly out from and longitudinally down the axial length of said inward facing surface of said interior wall so that a maximum heat dispersion area is presented to said air chamber for heat transfer.

5. The device of claim 3 wherein said transfer members comprise hollow cone-shaped projections open at both ends and attached at a plurality of closely-spaced positions throughout said inward facing surface of said interior wall so that a maximum heat dispersing area is presented to said air chamber for heat transfer.

6. The device of claim 1 wherein each said air outlet means comprises an edge wall having a plurality of air outlet openings and being attached between the outer adjacent edges of said interior wall and said concentric outer wall.

7. The device of claim 1 wherein said pressurized air source comprises a blower means for moving the heated air of said air chamber out said air outlet is attached in fluid communication with said chamber.

8. The device of claim 7 wherein a thermostat controls the operation of said blower means.

9. The device of claim 1 wherein said interior wall surface is made of copper.

10. The device of claim 1 wherein said interior wall and said concentric outer wall are spaced apart in such a manner that said air chamber is of narrow width.

* * * * *